United States Patent [19]

Cook, II

[11] Patent Number: 5,008,598

[45] Date of Patent: Apr. 16, 1991

[54] FLUORESCENT LIGHTING CONTROL CIRCUIT

[75] Inventor: James C. Cook, II, Marshall, Mich.

[73] Assignee: Progressive Dynamics, Inc., Marshall, Mich.

[21] Appl. No.: 461,221

[22] Filed: Jan. 5, 1990

[51] Int. Cl.[5] ..... H05B 41/36

[52] U.S. Cl. ..... 315/225; 315/219; 315/DIG. 7

[58] Field of Search ..... 315/225, 219, 209 R, 315/DIG. 7, DIG. 5, 307, 315, 362

[56] References Cited

U.S. PATENT DOCUMENTS 4,392,087 7/1983 Zansky ..... 315/219

4,667,131 5/1987 Nilssen ..... 315/225 X

*Primary Examiner*—Eugene R. LaRoche

*Assistant Examiner*—Ali Neyzari

*Attorney, Agent, or Firm*—Price, Heneveld, Cooper, DeWitt & Litton

[57] ABSTRACT

A control circuit for fluorescent lamps having gas filled tubes and a pair of discharge electrodes in the tubes includes a transformer, a gated switching device and a control signal generating circuit. The transformer has a secondary winding connected with the lamp discharge electrodes and a primary winding to which power is applied by the switching device when a gating signal is applied to its gating terminal. The control signal generating circuit normally controls the gating of the switching device by alternatingly applying, and then ceasing to apply, a control signal to the gating terminal. The control circuit is capable of continuing a current between the discharge electrodes once the lamp is conducting. The control circuit is further capable of "starting" a lamp by applying a high voltage to the discharge electrodes. The high voltage is generated when the gated switching device is not applying power to the primary winding. In order to avoid arcing and corona discharge in the control circuit as a result of misconnected and leaky fluorescent lamps, a voltage responsive device is connected with the gating terminal and responds to the voltage across the primary winding by applying a signal to the gating terminal in order to switch the switching device to apply power to the primary winding and, in this manner, causing the transformer to cease the generation of the damaging high voltage.

8 Claims, 1 Drawing Sheet

FLUORESCENT LIGHTING CONTROL CIRCUIT

BACKGROUND OF THE INVENTION

This invention relates to control circuits for gas discharge lamps. The invention is especially adapted for fluorescent lamp control circuits.

Low-cost control circuits for powering fluorescent lamps from low voltage DC power sources are well-known. Such circuits typically maintain an AC current through a pair of fluorescent lamps, once the lamps are in a conductive state, and produce a high voltage between opposite filaments of the fluorescent lamps to ignite the fluorescent lamp if it is not in a conductive state.

One problem with such known control circuits for fluorescent lamps is that, if one of the fluorescent lamps is not properly seated in its socket, or if a lamp becomes leaky and thus contaminated with air, the high voltage cannot ignite the lamp. This causes the high voltage to continue to rise and may result in arcing and corona discharge in the control circuit, which may destroy or significantly limit the life of the control circuit. While some forms of protection of the control circuit would be apparent to the skilled artisan, such as the use of a metal oxide varistor or zener diode across the terminals producing the high voltage, such form of protection would not be satisfactory. In order to provide protection, the power requirements of such protection devices would be very large and their expense prohibitive for a low-cost supply.

SUMMARY OF THE INVENTION

The present invention is directed to reducing or eliminating arcing and corona discharge in a control circuit for fluorescent lamps in cases where the fluorescent lamps fail to ignite in a manner that eliminates the need for large, expensive over-voltage protection devices. The invention is embodied in a control circuit for a gas discharge lamp having a gas filled chamber and at least one pair of discharge electrodes. The control circuit includes a transformer, a primary winding and a secondary winding, and a gated switching device having a gating terminal and selective conducting means. The selective conducting means is responsive to a signal being applied to the gating terminal for applying a supply voltage to the primary winding. The control circuit further has control signal generating means for selectively applying a signal to the gating terminal of the switching device when the control circuit is in a first state but not when it is in a second state. The secondary winding is adapted to attempting to establish a current between the discharge electrodes of the lamp when a current is not being conducted between the electrodes and the control circuit is in the second state. Protection means is provided for applying a signal to the gating terminal when said control circuit is in the second state and fails to establish a current between the discharge electrodes. In this manner, the control circuit is switched to a conducting state upon failure to ignite the gas discharge lamp and the voltage developed by the control circuit is thereby limited.

These and other objects, advantages and features of this invention will become apparent upon review of the following specification in conjunction with the drawings.

DESCRIPTION OF THE PREFERRED EMBODIMENT

Figure 1:
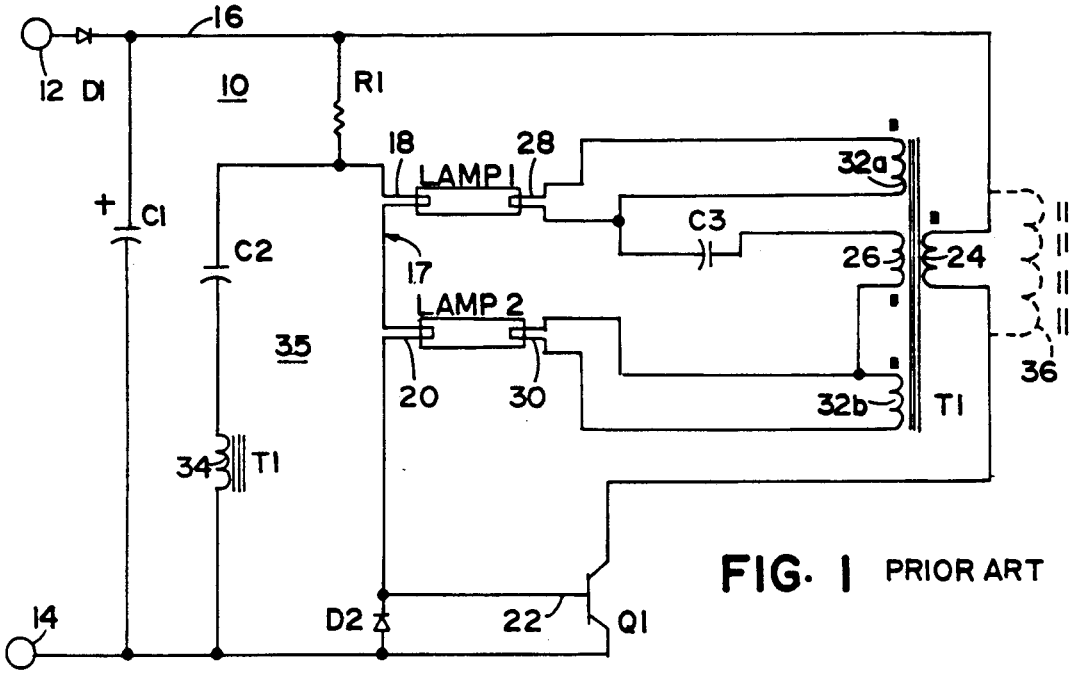
FIG. 1 PRIOR ART
FIG. 1 is an electrical schematic diagram of a conventional fluorescent lighting control circuit operable from a low voltage source.

Referring now specifically to the drawings, and the illustrative embodiments depicted therein, a conventional fluorescent lamp control circuit 10 of the type known in the prior art is illustrated in FIG. 1. Fluorescent lamp control circuit 10 includes a pair of terminals 12, 14 connected with a low voltage DC power source (not shown). The power source may be a regulated DC, pulsed DC, or rectified AC power source. A forward-poled diode D1 is connected between terminal 12 and a line 16 in order to protect circuit 10 against reverse polarity connection. In addition, when circuit 10 is connected with a pulsating DC or rectified AC power source, diode D1 prevents capacitor C1 from discharging. Capacitor C1 is provided to filter out AC components from pulsed or rectified power sources. In addition, capacitor C1 keeps switching transients from the power source to reduce electromagnetic noise generation. A resistor R1 is connected with line 16 in series with a branch 17. Branch 17 includes a first filament 18 of a fluorescent lamp 1 connected in series with a first filament 20 of a fluorescent lamp 2. Branch 17 is, in turn, connected with the base 22 of a transistor Q1.

Transistor Q1 is a switching transistor having a high beta, or hfe. This high beta forces the switching transistor in normal operation to be either off or in saturation. The emitter-collector junction of transistor Q1 is in series with a primary winding 24 of a transformer T1. Transformer T1 has a secondary winding 26 having an approximately 10:1 step-up turns ratio with respect to primary winding 24. Secondary winding 26 is connected with second filaments 28 and 30 of fluorescent lamps 1 and 2, respectively, in series with a capacitor C3. Transformer T1 additionally has a pair of low-turn filament windings **32*a*, 32*b*, for circulating current through filaments 28 and 30, and a feedback winding 34 connected in a circuit 35 that includes a capacitor C2 and branch 17. Transformer T1 has a gap in its magnetic circuit which stores magnetic energy. The effect of this gap is the equivalent of an inductor 36 in parallel with primary winding 24. In the illustrated embodiment, which is a sixteen watt circuit, gap inductance 36** in nominally 56 microhenries.

In operation, during a first state of circuit 10, a current is produced from the power source through terminal 12, diode D1, and resistor R1. The current is fed to base 22 of transistor Q1 and through terminal 14 back to the power source. Because of the high beta of transistor Q1, this current switches Q1 into saturation. With Q1 conducting, full supply voltage is provided across primary winding 24. The voltage across winding 24 is reflected in feedback winding 34 which produces a current clockwise in circuit 35. The current in circuit 35 supplies the major base current to transistor Q1 and is superimposed on the smaller base-drive current supplied from the power source through diode D1 and resistor R1. Since the current in circuit 35 flows through capacitor C2 and charges it with a polarity opposing this current, the base current supplied from circuit 35 decreases in time. The voltage across primary winding 2 additionally is reflected in the secondary winding 26. If lamps 1 and 2 are in a conductive state, the voltage across secondary winding 26 causes current to flow through both lamps. This current through the lamps also flows through capacitor C3 and decreases with time as capacitor C3 charges. The voltage across primary winding 24 additionally causes an inductance current in gap inductance 36, which increases with time.

Eventually, capacitor C2 charges sufficiently to reduce the base current supplied to base 22 of transistor Q1 below the level that will keep transistor Q1 conducting. At such moment, transistor Q1 rapidly ceases to conduct. When transistor Q1 ceases to conduct, control circuit 10 is in a second state in which capacitor C3 and the gap inductance begin to release their energy. This release of energy will cause a reverse flow current through lamps 1 and 2, provided that the lamps are in a conductive state. If the lamps are not in a conductive state, the discharge of gap inductor 36 produces a high voltage across secondary winding 26 of a sufficient level to cause lamps 1 and 2, to ignite or start. The discharge of gap inductor 36 and capacitor C3 is reflected in feedback winding 34 as a voltage opposite to that in stage 1 when transistor Q1 is conducting. This causes a reverse, or counterclockwise, current to flow through circuit 35 by way of diode D2, changing the polarity of capacitor C2.

This current through diode D2 and branch 17 of circuit 35 is counter to the current produced through diode D1 and resistor R1 from the power source and will prevent the current through D1 and R1 from driving transistor Q1 into saturation. This current through diode D2 decreases as gap inductor 36 and capacitor C3 run out of energy to discharge and as capacitor C2 charges in opposition to this current. The current through diode D1 and resistor R1 will eventually overcome this decreasing current through diode D2. When this occurs, Q1 will be driven into saturation and control circuit 10 will return to state 1, previously described.

The problem with the prior art fluorescent lamp control, circuit 10 disclosed in FIG. 1 is that if either lamp 1 or lamp 2, or both, are not properly seated in their respective sockets, or if one, or both, of the lamps are leaky, the discharge of gap inductor 36 causes a very large high voltage to develop across secondary winding 26 of transformer T1. This high voltage is normally useful to ignite lamps 1 and 2 if they are not in their conductive state and, therefore, serves a useful purpose. However, if lamps 1 and 2 cannot ignite for these or other reasons, a dangerous high voltage is developed across transformer T1 which may create arcing and/or coronal discharge in control circuit 10.

Figure 2:
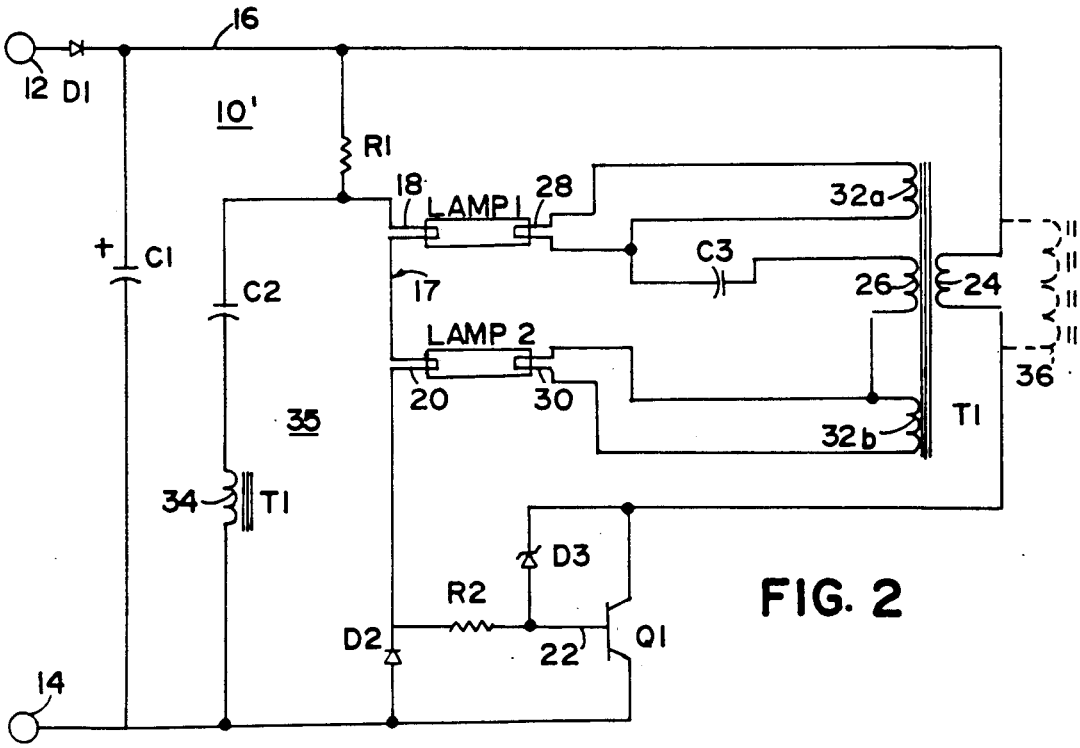
FIG. 2 is an electrical schematic diagram of a fluorescent lighting control circuit according to the present invention.

Referring to FIG. 2, a fluorescent lamp control circuit 10', which is otherwise identical to control circuit 10 in FIG. 1, includes a zener diode D3 connected between the collector and base 22 of transistor Q1 and a resistor R2 connected between branch 17 and base 22 of transistor Q1.

In lamp control circuit 10', the voltage across primary winding 24 of transformer T1 cannot exceed the voltage across D3 plus one PN junction minus the voltage across capacitor C1. Because the voltage across capacitor C1 is relatively constant, any build-up of voltage across primary winding 24 is immediately applied to zener diode D3. Once the voltage across zener diode D3 reaches break-over level, zener diode D3 begins to conduct a significant current. The purpose of the current through D3 is to cause transistor Q1 to resume a conducting state. If it is assumed that most of the current conducted through zener diode D3 enters the base of transistor Q1, the high beta of this transistor will ensure that most of the energy being discharged from the gap inductor will enter and be absorbed by transistor Q1, which is a power device. After all energy is discharged from gap inductor 36, circuit 10' will resume state 1 condition.

One problem is that reverse, or counterclockwise, current in circuit 35 conducted through diode D2 tends to cancel the current produced by zener diode D3. If the current produced by zener diode D3 is cancelled, it is not available to drive transistor Q1. This problem is especially great when control circuit 10 is in an overvoltage condition because this excessively high voltage is reflected in feedback winding 34 to circuit 35. In order to overcome this problem, resistor R2 is provided between circuit 35 and base 22 to limit the amount of current through zener diode D3 that can be cancelled by the reverse current in circuit 35 through diode D2. In other words, resistor R2 tends to isolate base 22 from circuit 35. However; the maximum voltage that can develop across resistor R2 is two PN junctions. This allows the resistance of R2 to be selected as a low value in order to avoid interference with the normal operation of the control circuit 10'. With zener diode D3 selected at 75 volts, one watt, circuit 10' is capable of producing 750 volts for ignition of lamps 1 and 2. While this is sufficient for lamp ignition, it is not high enough of a voltage to typically create corona and/or arcing in control circuit 10'.

The values and/or identities the components in FIGS. 1 and 2 of the illustrated embodiment are as follows:

| | |
|---|---|
| D1 | IN5401 |
| C1 | 220 uf, 35 volt |
| R1 | 200 to 1k ohms |
| C2 | 0.22 uf |
| C3 | 0.0082 uf |
| D2 | IN4001 |
| R2 | 22 ohms |
| D3 | IN4761 |
| Q1 | BU407 |

Lamps 1 and 2 are Model F8T5 fluorescent lamps marketed by several vendors of fluorescent lamps. Primary winding 24 is 16 turns of #29 wire, secondary winding 26 is 185 turns of #29, wire, feedback winding 34 is 8 turns of #29 wire and each filament winding **32*a*, 32*b* is 4 turns of #29 wire. The core halves for transformer T1** are commercially available and sold by Ferroxcube under Model No. 812E250-3C8. These core halves (not shown) are nominally gapped to provide a primary-referred inductance of 56 microhenries.

Changes and modifications in the specifically described embodiments can be carried out without departing from the principles of the invention which is intended to be limited only by the scope of the appended claims, as interpreted according to the principles of patent law, including the doctrine of equivalents.

The embodiments of the invention in which an exclusive property or privilege is claimed are defined as follows:

1. A control circuit for a gas discharge lamp, said lamp having a gas filled chamber and at least one pair of discharge electrodes in said gas filled chamber, said control circuit comprising:

a transformer including a primary winding and a secondary winding;

a gated switch means having a gating terminal and selective conducting means responsive to a signal being applied to said gating terminal for applying a supply voltage to said primary winding;

control signal generating means for selectively applying a signal to said gating terminal when said control circuit is in a first state and for not applying a signal to said gating terminal when said control circuit is in a second state;

said secondary winding being adapted to attempting to establish a current between said discharge electrodes upon the occurrence of both a current not being conducted between said discharge electrodes and said control circuit being in said second state; and protection means for applying a signal to said gating terminal upon the occurrence of both said control circuit being in said second state and failure of said secondary winding to establish a current between said discharge electrodes;

said secondary winding includes means for producing a high voltage in order to attempt to establish a current between said discharge electrodes and wherein said protection means includes means responsive to said high voltage exceeding a predetermined level.

2. The control circuit in claim 1 wherein said responsive means includes a voltage-responsive signal generating means between said primary winding and said gating terminal for applying a signal to said gating terminal when the voltage across said primary winding exceeds a predetermined voltage.

3. The control circuit in claim 1 wherien said transformer includes energy storage means and wherein said primary winding transfers energy to said energy storage means when said control circuit is in said first state and wherein said energy storage means transfers energy to said secondary winding when said control circuit is in said second state unless said protection means is applying said signal to said gating terminal.

4. The control circuit in claim 1 wherein said control signal generating means includes energy storage means and means responsive to the voltage across said primary winding for defining oscillation means for alternatingly applying a signal to said gating terminal and ceasing to apply a signal to said gating terminal.

5. In a control circuit for supplying power to a gas discharge lamp from a power source, said lamp having a gas filled chamber at least one pair of discharge electrodes in said gas filled chamber;

said control circuit having an output device with output terminals for connecting with said at least one pair of discharge electrodes, a first input terminal for connection with source of power and a second input terminal for connection with a gated switching device;

said control circuit further having control signal generating means for producing a control signal and providing said control signal to a gating terminal of said switching device to intermittently gate said switching device and thereby cause said output device to deliver power to said lamp, said output device being capable of delivering high voltage power to said lamp to initiate current conductance between said pair of discharge electrodes when said switching device is not being gated, wherein the improvement comprises:

voltage responsive conducting means between said gating terminal and one of said input terminals for applying a control signal to said gating terminal in response to an increase in voltage across said input terminals and thereby limiting the voltage developed by said output device;

said voltage responsive conducting means includes selective conducting means for conducting current when said voltage across said input terminals is above a predetermined level;

said voltage responsive conducting means further includes an impedance device between said control signal generating means and said gating terminal to reduce the tendency of current conducted by said selective conducting means from being diverted away from said gating terminal.

6. The improved control circuit in claim 5 wherein said selective conducting means is a zener diode.

7. A control circuit for supplying power to a gas discharge lamp from a power source, said lamp having a gas filled chamber and at least one pair of discharge electrodes in said gas filled chamber, said control circuit comprising:

a transformer including a primary winding and at least one secondary winding;

gated switch means including a gating terminal and a pair of switched terminals, at least one of said switched terminals connected with said transformer for selectively applying electrical energy to said primary winding in response to a control signal being supplied to said gating terminal;

control signal generating means for generating a control signal, said control signal generating means including feedback means responsive to electrical energy being supplied to said primary winding for affecting the level of said control signal;

lamp current generating means for generating a current through said gas filled chamber, said lamp current generating means including said secondary winding and means for connecting said secondary winding to said discharge electrodes;

energy storage means operatively associated with said transformer for storing electrical energy such that said control circuit will oscillate between a first state in which said control signal generating means supplies a control signal to said gating terminal causing said switching means to apply electrical energy to said transformer primary winding and said energy storage means, and a second state in which said feedback means responsive to electrical energy being applied to said transformer primary winding to cause said control signal generating means to cease supplying said control signal to said gating terminal such that said switching means ceases to apply electrical energy to said transformer primary winding and said energy storage means releases stored electrical energy to said secondary winding; and voltage responsive conducting means for applying a signal to said gating terminal in response to an increase in voltage across said primary winding and thereby limiting the voltage across said transformer windings when said control circuit is in said second state;

said voltage responsive conducting means includes selective conducting means for conducting current when said voltage across said transformer winding is above a predetemrined level;

said voltage responsive conducting means further includes an impedance device between said control signal generating means and said gating terminal to reduce the tendency of current conducted by said selective means from being diverted to said control signal generating means when said control circuit is in said second state.

8. The control circuit in claim 7 wherein said selective conducting means is a zener diode.

* * * * *

UNITED STATES PATENT AND TRADEMARK OFFICE

CERTIFICATE OF CORRECTION

PATENT NO. : 5,008,598

DATED : April 16, 1991

INVENTOR(S) : James C. Cook II

It is certified that error appears in the above-identified patent and that said Letters Patent is hereby corrected as shown below:

Column 3, Line3:
"winding 2" should be --winding 24--;
Column 4, Line 26:
"However;" should be --However,--;
Column 4, Line 53:
After "#29" delete --,--;
Column 5, Line 39, Claim 3:
"wherien" should be --wherein--;
Column 7, claim 7, Line 6:
"predemrined" should be --predetermined--.

Signed and Sealed this

Eighth Day of September, 1992

*Attest:*

DOUGLAS B. COMER

*Attesting Officer*

*Acting Commissioner of Patents and Trademarks*